US011361685B2

(12) United States Patent
Larsen et al.

(10) Patent No.: US 11,361,685 B2
(45) Date of Patent: Jun. 14, 2022

(54) RETAIL DISPLAY HEADER AND ASSOCIATED SYSTEM

(71) Applicant: TARGET BRANDS, INC., Minneapolis, MN (US)

(72) Inventors: Selina Larsen, Duluth, MN (US); Jacob K. Pomputis, Lakeville, MN (US); Scott J. Fuenffinger, Centerville, MN (US)

(73) Assignee: Target Brands, Inc., Minneapolis, MN (US)

( * ) Notice: Subject to any disclaimer, the term of this patent is extended or adjusted under 35 U.S.C. 154(b) by 91 days.

(21) Appl. No.: 16/950,114

(22) Filed: Nov. 17, 2020

(65) Prior Publication Data

US 2022/0157208 A1 May 19, 2022

(51) Int. Cl.
*G09F 15/00* (2006.01)

(52) U.S. Cl.
CPC ..... *G09F 15/0018* (2013.01)

(58) Field of Classification Search
None
See application file for complete search history.

(56) References Cited

U.S. PATENT DOCUMENTS 620,522 A 2/1899 Williams
1,758,511 A 5/1930 Gross
4,113,109 A * 9/1978 Donnelli ..... B65D 77/22 211/49.1
4,122,604 A 9/1978 Ott et al.
4,334,374 A * 6/1982 Spamer ..... G09F 15/0068 40/607.02
D268,010 S 2/1983 O'Brien
4,379,373 A * 4/1983 Transport ..... G09F 1/06 40/750
4,672,757 A * 6/1987 Field ..... G09F 3/18 40/661
5,123,189 A * 6/1992 Fast ..... A47F 5/0869 40/642.01
D400,438 S 11/1998 Correll
(Continued)

OTHER PUBLICATIONS

Larsen, Selina. U.S. Appl. No. 16/950,900, filed Nov. 17, 2020 (45 pages).

(Continued)

*Primary Examiner* — David R Dunn
*Assistant Examiner* — Christopher E Veraa
(74) *Attorney, Agent, or Firm* — JoAnn M. Seaton; Griffiths & Seaton PLLC

(57) ABSTRACT

A header for coupling to a retail display structure includes a front panel and a rear panel. The rear panel is formed coplanarly with the front panel, bordering the front panel along a longitudinal fold line. The rear panel is folded about the longitudinal fold line to fit adjacent and be adhered to an interior surface of the front panel. Hooks are initially coplanarly formed in an interior of the rear panel and coupled to a remainder of the rear panel via a fold line. Each of the hooks is folded rearwardly away from the rear panel defining an offset portion and a downwardly extending portion. The downwardly extending portion is spaced from the rear panel to receive at least a portion of the retail display structure between the exterior surface of the rear panel and the downwardly extending portion of each of the hooks.

20 Claims, 13 Drawing Sheets

(56) References Cited

U.S. PATENT DOCUMENTS

| | | | | |
|---|---|---|---|---|
| 6,167,644 | B1 * | 1/2001 | Fox | G09F 1/10 40/124.14 |
| D501,341 | S | 2/2005 | Cassidy et al. | |
| D512,462 | S | 12/2005 | Matuel et al. | |
| D723,844 | S | 3/2015 | Hawkins | |
| D741,408 | S | 10/2015 | Engelby et al. | |
| 9,215,940 | B2 | 12/2015 | Hawkins | |
| 9,930,913 | B2 | 4/2018 | Fath | |
| 10,123,634 | B2 | 11/2018 | Volz et al. | |
| 10,322,735 | B2 | 6/2019 | Parker | |
| 10,971,038 | B2 * | 4/2021 | Shea | A47F 5/083 |
| 2013/0240134 | A1 * | 9/2013 | Flynn | G09F 3/10 156/60 |

OTHER PUBLICATIONS

Dr. Pepper Display Sign Photograph, printed from https://i.pinimg.com/originals/cb/56/b0/cb56b078ebb645f2efcd2e7ce8377c16.jpg, publicly available at least as early as Mar. 20, 2020 (1 page).

* cited by examiner

RETAIL DISPLAY HEADER AND ASSOCIATED SYSTEM

BACKGROUND OF THE INVENTION

Signs are commonly used in retail settings to present information to customers about a promotion and/or a product for purchase. For example, overhead signs are hung over a grouping of display structures including related products and are used to indicate a general location of the products. Upright signs can be positioned adjacent display structures or in aisles between display structures to direct the customer to a product location or to inform the customer of sales or promotions. In other instances, signs are attached directly to the display structures, such as on shelving, to provide identifying and/or price information to the customer.

SUMMARY

One aspect of the present invention relates to a header configured to be coupled to a retail display structure includes a front panel and a rear panel. The rear panel is formed coplanarly with the front panel and borders the front panel along a longitudinally extending fold line. The rear panel is folded about the longitudinally extending fold line to fit adjacent to and be adhered to an interior surface of the front panel. The at least two hooks are initially coplanarly formed in an interior of the rear panel and coupled to a remainder of the rear panel via a fold line. Each of the at least two hooks is folded rearwardly away from the rear panel to define an offset portion and a downwardly extending portion. The downwardly extending portion is spaced from an exterior surface of the rear panel via the offset portion in a manner configured to receive at least a portion of the retail display structure between the exterior surface of the rear panel and the downwardly extending portion of each of the at least two hooks. Other systems, fixtures, headers, assemblies, methods, etc. are also disclosed.

BRIEF DESCRIPTION OF THE DRAWINGS

Embodiments of the invention will be described with respect to the figures, in which like reference numerals denote like elements, and in which.

DETAILED DESCRIPTION

The following detailed description of the invention provides example embodiments and is not intended to limit the invention or the application and uses of the invention. Furthermore, there is no intention to be bound by any theory presented in the preceding background of the invention or the following detailed description of the invention. Relational terms herein such a first, second, top, bottom, etc. may be used herein solely to distinguish one entity or action from another without necessarily requiring or implying an actual such relationship or order. In addition, as used herein, the terms "about" and "substantially" each applies to all numeric values or descriptive terms, respectively, and generally indicate a range of numbers or characteristics that one of skill in the art would consider equivalent to the recited values or terms, that is, having the same function or results.

A header is provided for displaying indicia on a retail display fixture and is configured to draw the attention of consumers, to inform consumers about the price or other features of items offered for retail sale, to enhance aesthetics of a retail environment, to identify the items offered for retail sale near the header, and/or to direct a consumer toward the location of items offered for retail sale. In one embodiment, the header is formed of a single, substantially planar blank folded about fold lines and perforations to form integral hooks extending rearwardly form a back of a sign. The integral hooks, folded out of plane with a front of the sign, have a downward orientation configured to receive a cross bar of a retail display fixture such that the header extends in a longitudinal direction largely covering a front of the cross bar.

Figure 1:
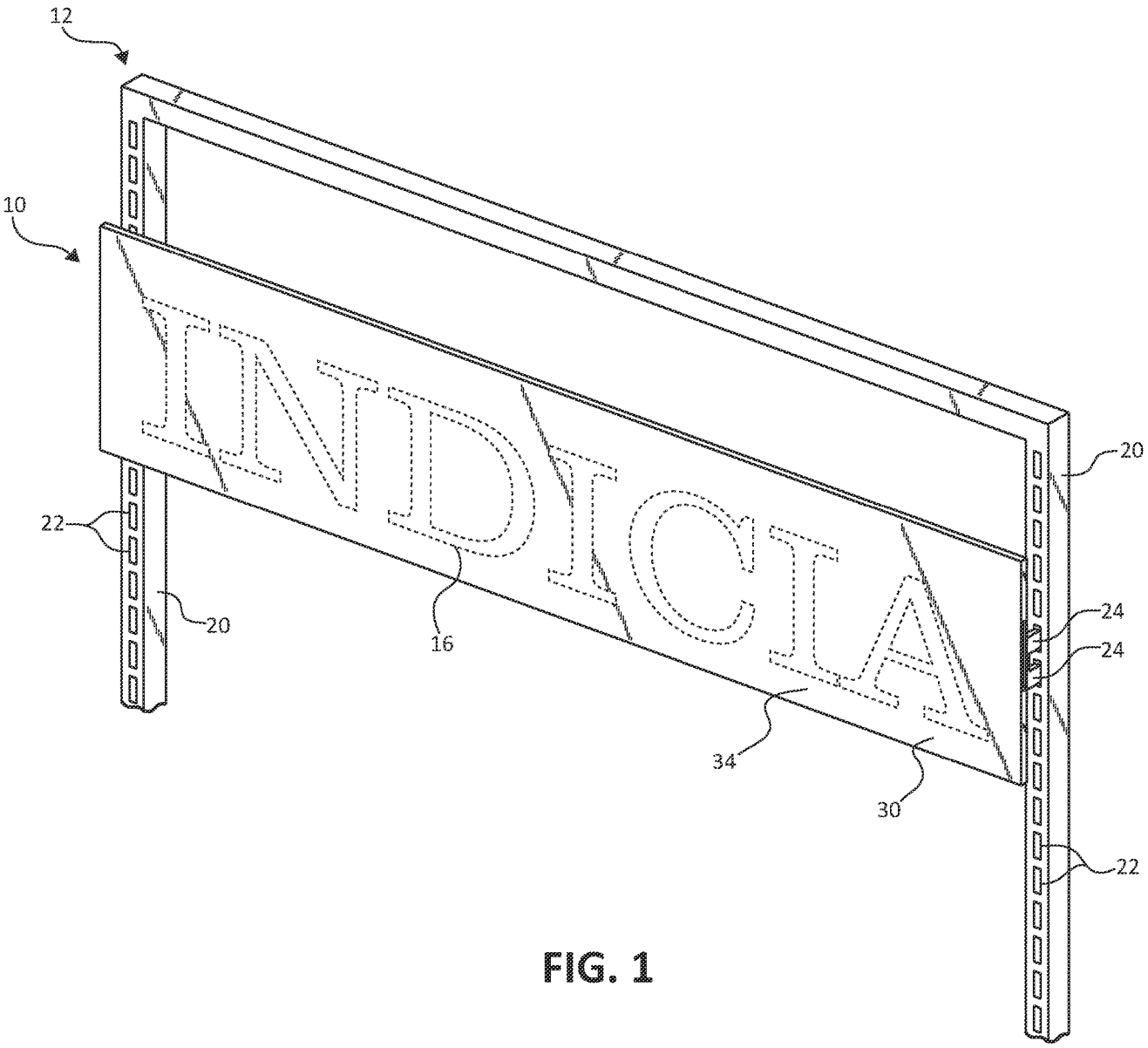
FIG. 1 is a front, perspective view illustration of a retail display fixture including a horizontal fixture member and a header 10 supported thereon, according to one embodiment of the present invention.
Figure 2:
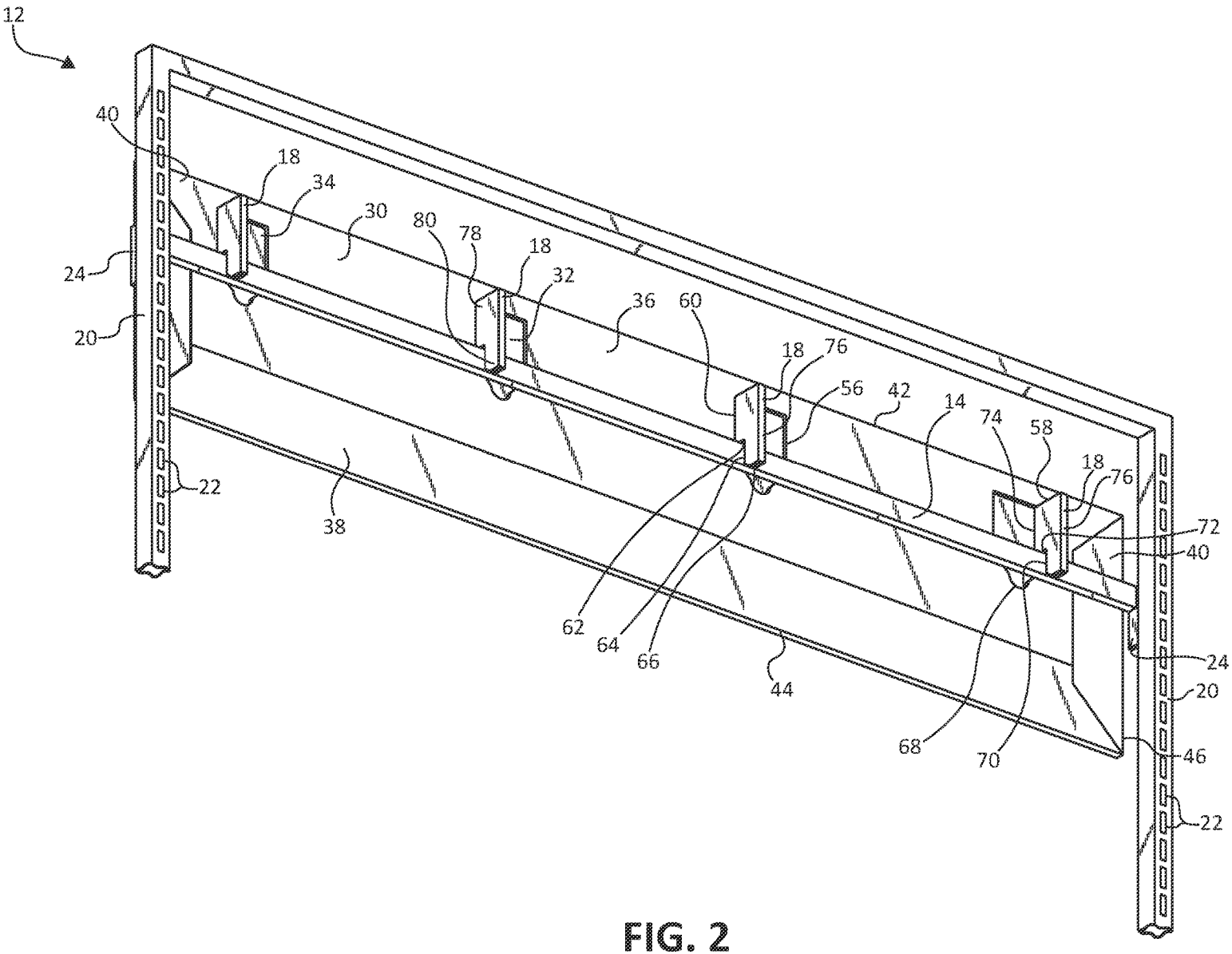
FIG. 2 is a rear, perspective view illustration of the retail display fixture of FIG. 1, according to one embodiment of the present invention.
Figure 3:
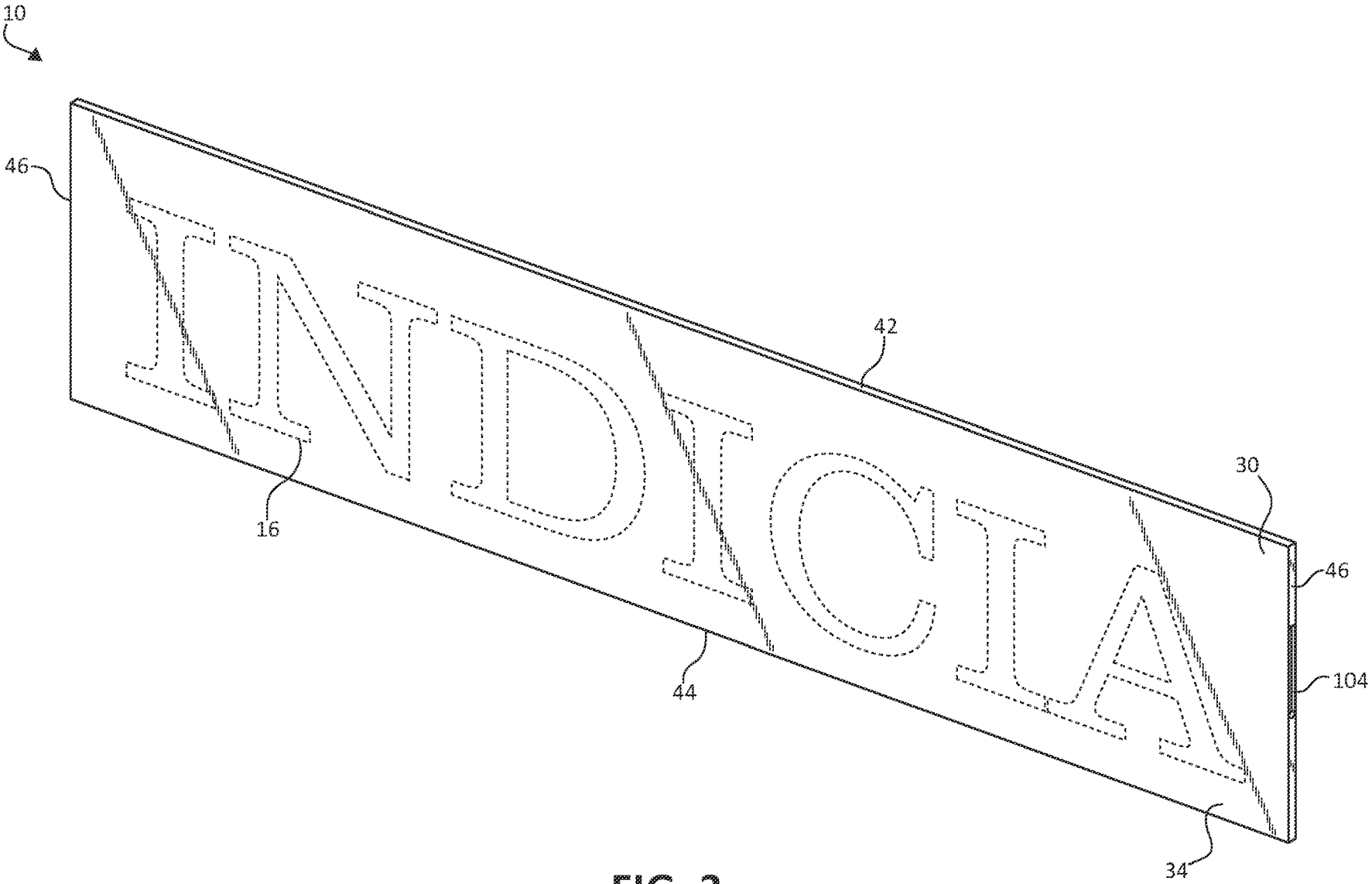
FIG. 3 is front, perspective view illustration of the header of FIG. 1, according to one embodiment of the present invention.
Figure 4:
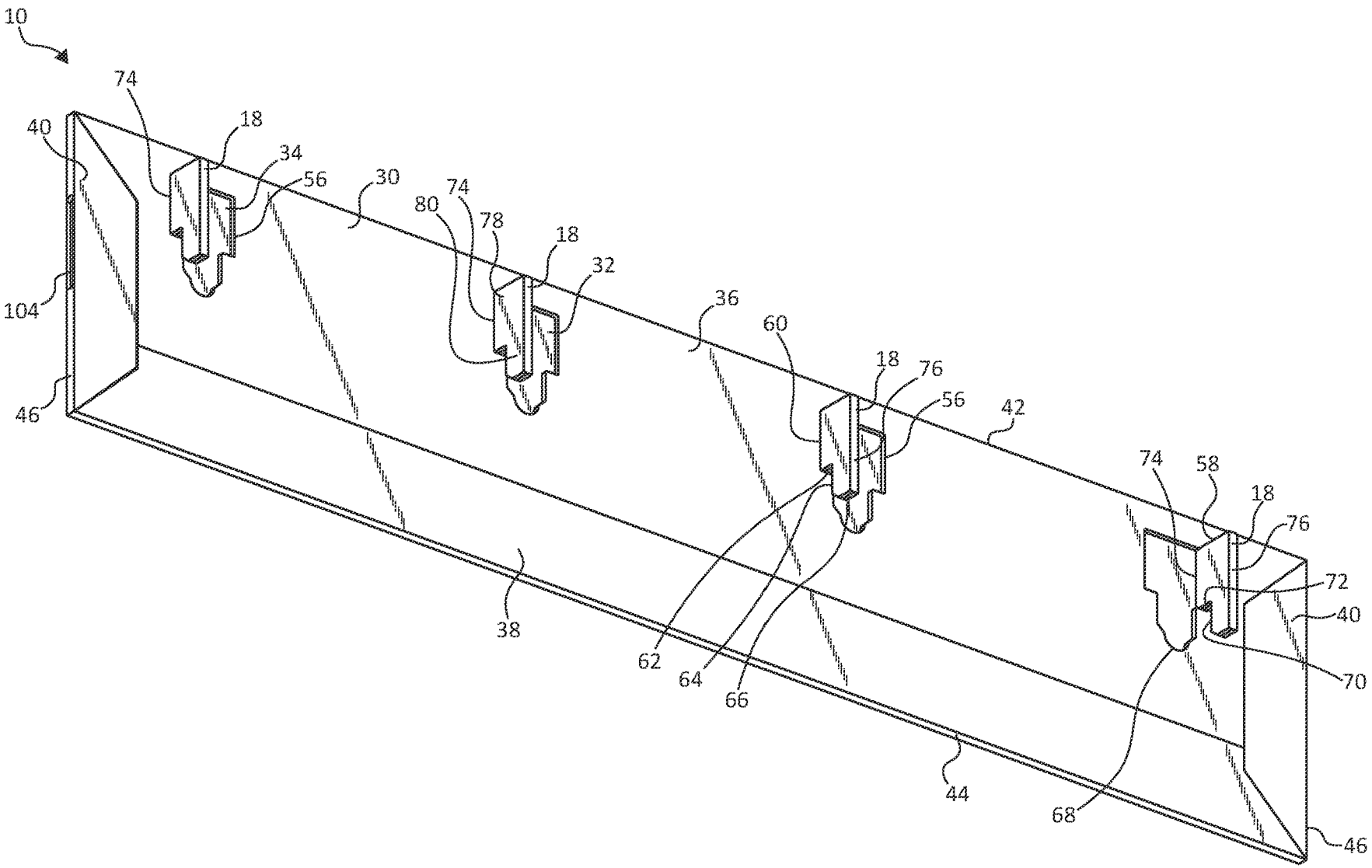
FIG. 4 is a rear, perspective view illustration of the header of FIG. 3, according to one embodiment of the present invention.
Figure 5:
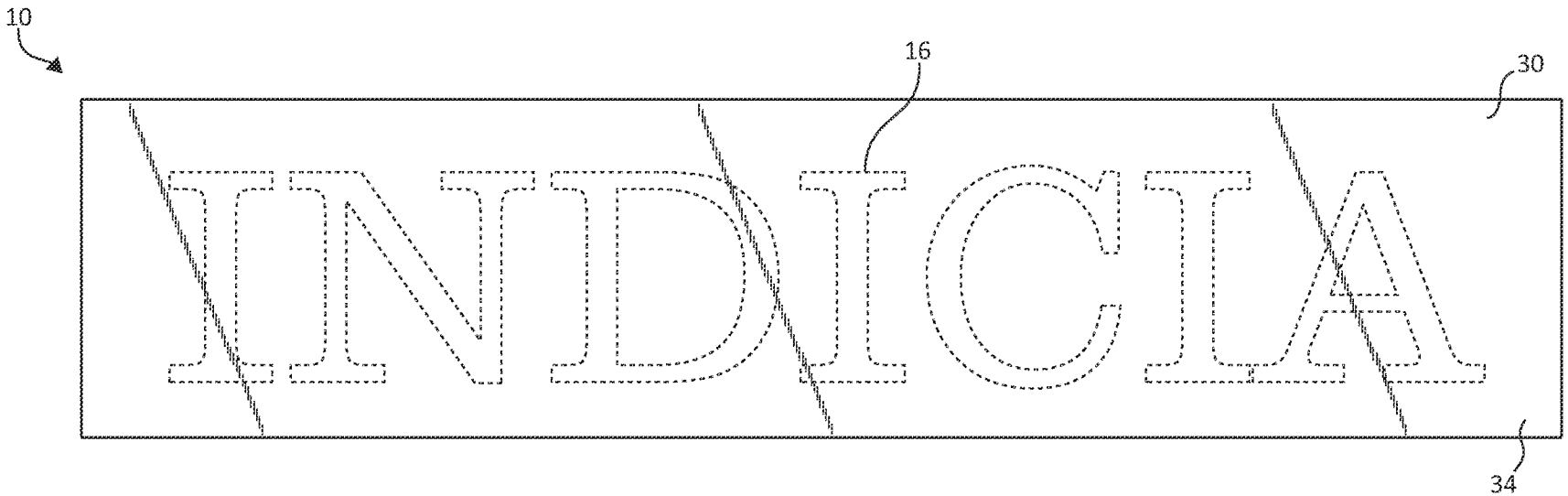
FIG. 5 is a front view illustration of the header of FIG. 3, according to one embodiment of the present invention.
Figure 6:
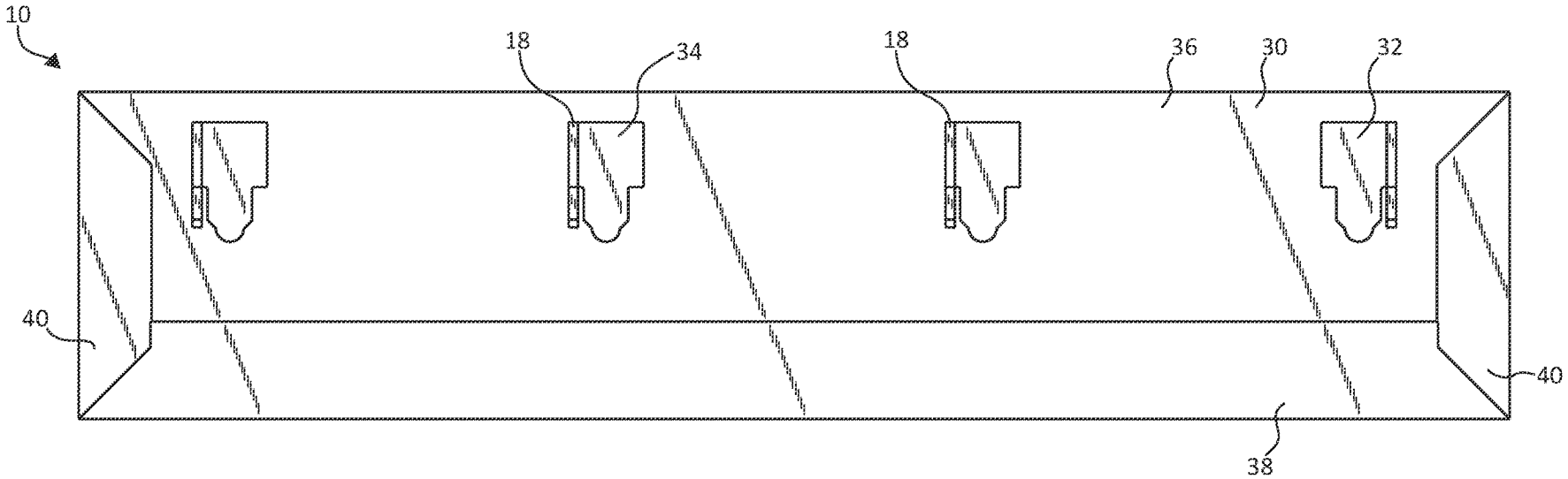
FIG. 6 is a rear view illustration of the header of FIG. 3, according to one embodiment of the present invention.
Figure 8:
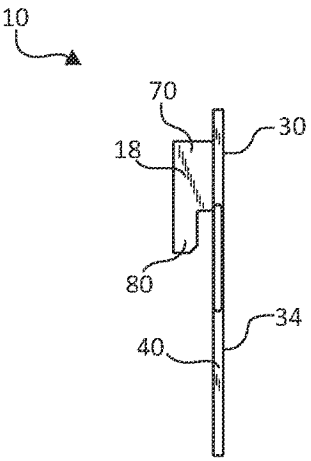
FIG. 8 is a left side view illustration of the header of FIG. 3, according to one embodiment of the present invention.
Figure 7:
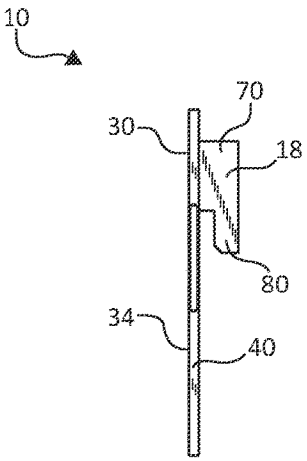
FIG. 7 is a right side view illustration of the header of FIG. 3, according to one embodiment of the present invention.
Figure 9:
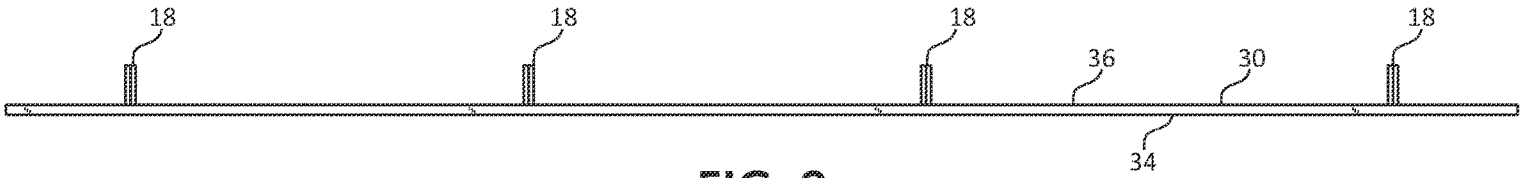
FIG. 9 is a top view illustration of the header of FIG. 3, according to one embodiment of the present invention.
Figure 10:
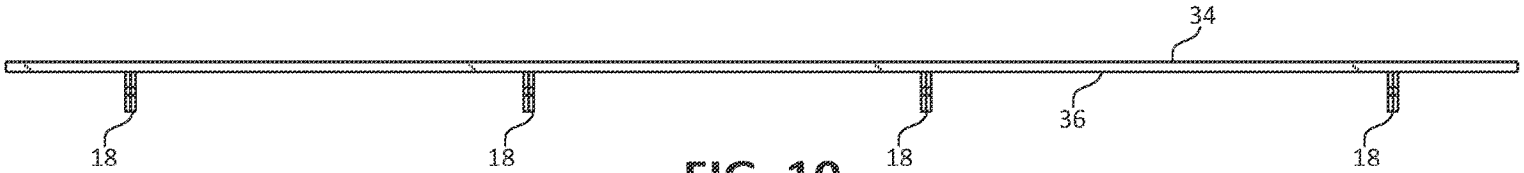
FIG. 10 is a bottom view illustration of the header of FIG. 3, according to one embodiment of the present invention.

Turning to the figures, FIGS. 1 and 2 illustrate one example of a retail display system 10 including a header 10 and fixture members, for example, including a cross bar 14 extending between two vertical support members 20. Header 10 including indicia 16, such as graphics, text, colors, etc. on a front surface thereof, and is formed with integral, fold out hooks 18 as shown, for example, in the fully assembled views of header 10 in FIGS. 3-10. Each of hooks 18 is configured to fit over cross bar 14 in a manner supporting header 10 on cross bar 14. More specifically, a front surface of header 10 generally extends in parallel to cross bar 14, as will be further described below.

The retail fixture members, that is, the assembly of vertical fixture members 20, cross bar 12, and any other may be positioned within a retail store or environment in any desired position, such as, along a wall of the environment and/or spaced from any said interior or exterior walls of the environment. In one example, vertical members 20 each define a linear array of slots 22 extending substantially vertically thereon, and cross bar 12 includes hooked mounts 24 on opposing ends thereof. In this manner, hooked mounts 24 are selectively engaged and disengaged with individual slots of each of the array of slots 22 to adjust placement of cross bar 12 vertically relative to vertical members 20 as desired for a particular display in the retail environment.

Figure 11:
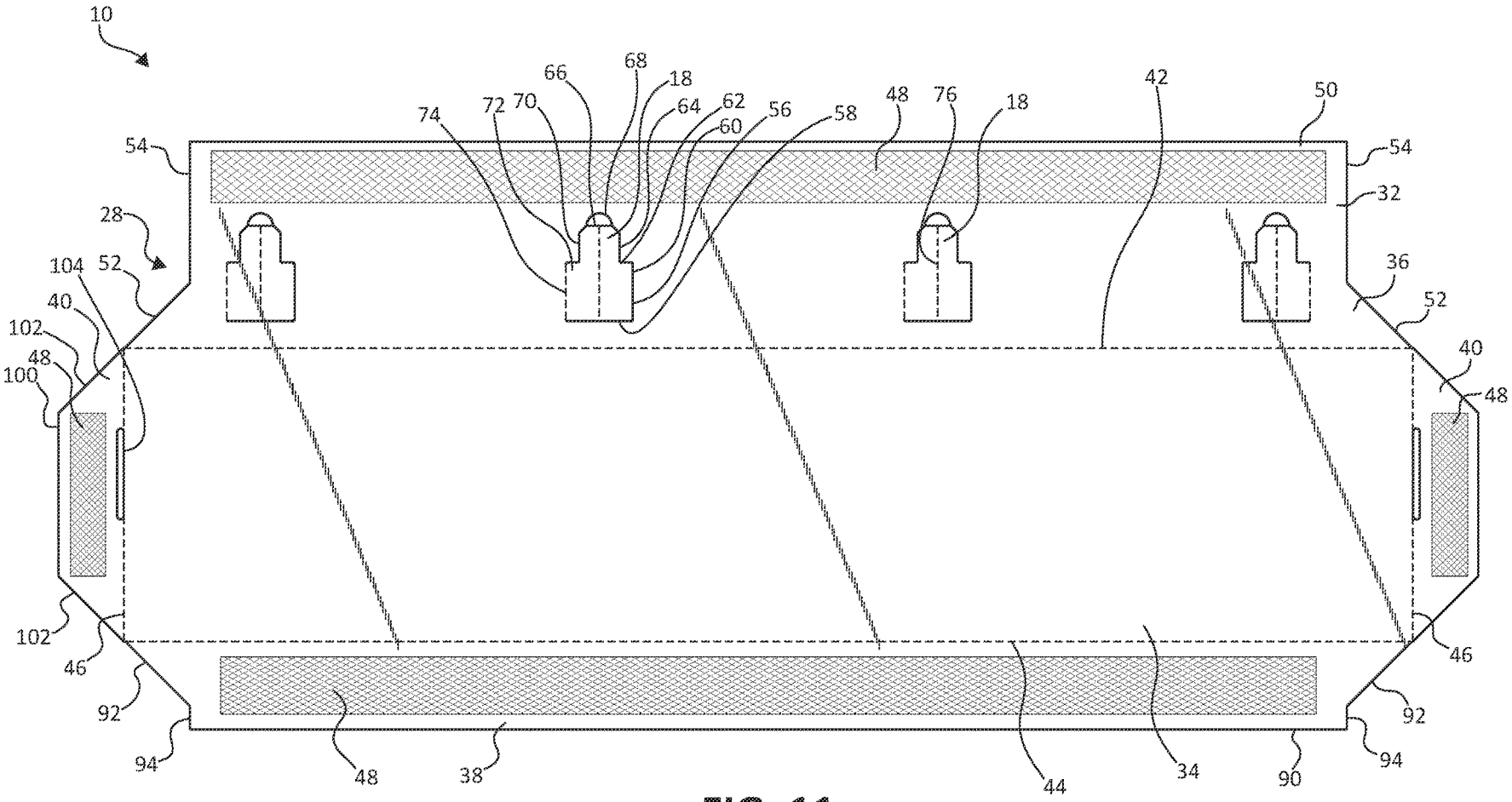
FIG. 11 is a rear view illustration of an unfolded header blank, according to one embodiment of the present invention.
Figure 12:
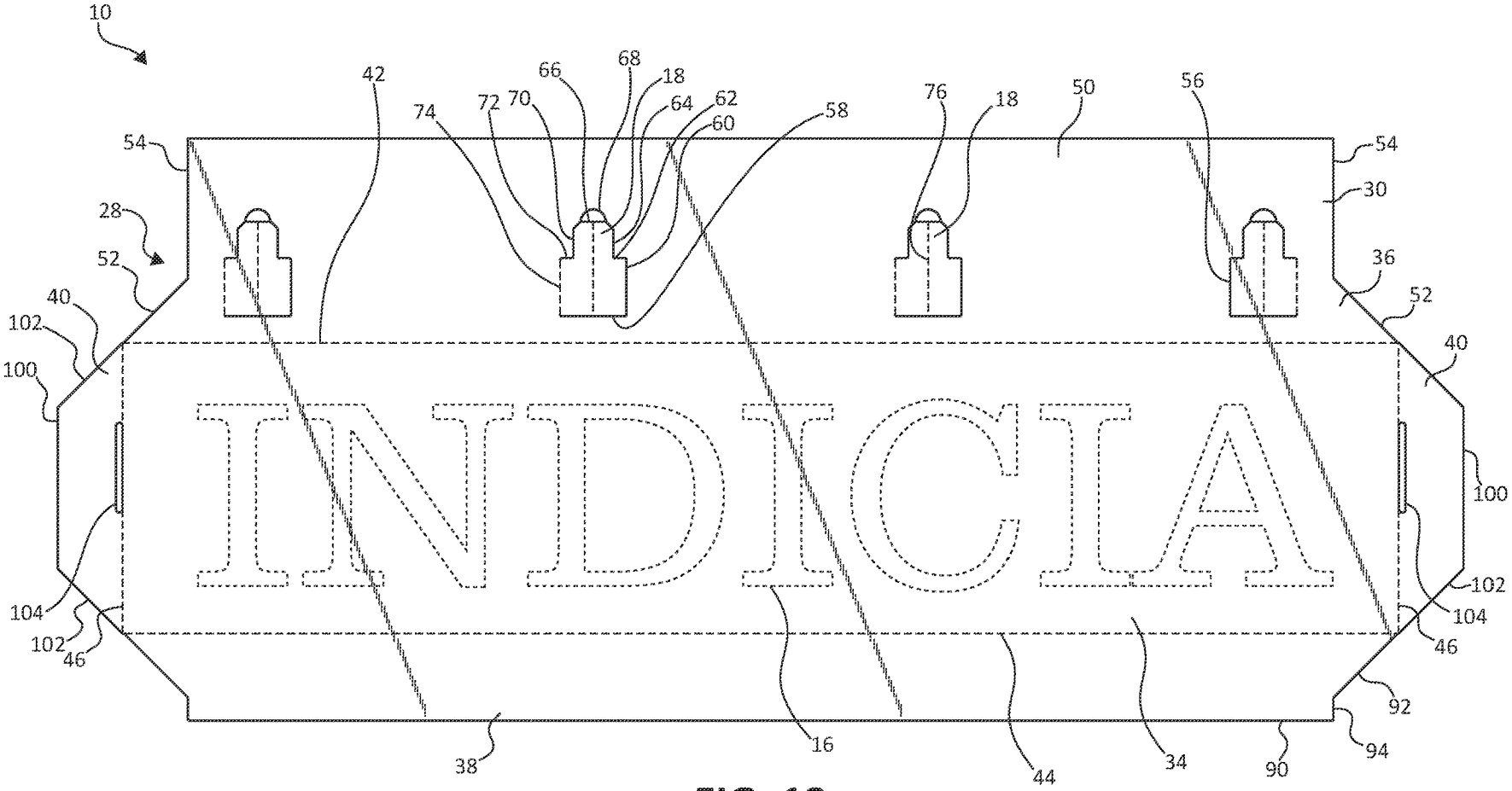
FIG. 12 is a front view illustration of the unfolded header blank of FIG. 11, according to one embodiment of the present invention.

Header 10 as shown in FIGS. 3-10 is initially formed of a substantially planar member in the form of a blank 28 as shown in FIGS. 11 and 12. Blank 28 is formed of paperboard, cardboard, pressed paper, plastic or other suitable material able to fold along defined fold lines and is configured with perforations cut therein to allow blank 28 to be folded to become header 10. In one embodiment, blank 28 defines a first or exterior surface 30 and a second or interior surfaced 32 opposite exterior surface 30. Each of exterior surface 30 and interior surface 32 are substantially planar and is in a parallel plane with the other of exterior surface 30 and interior surface 32.

Blank 28 is scored, marked, or otherwise formed with a plurality of fold lines defining a front panel 34, a primary rear panel 36, an auxiliary rear panel 38, and side panels 40, in one embodiment. For example, front panel 34 extends between a first substantially linear longitudinal fold line 42 and a second substantially linear fold line 44 in a substantially rectangular manner. Primary rear panel 36 extends from first fold line 42 to a free edge 50, where free edge is substantially parallel to first fold line 42, in one embodiment. Auxiliary rear panel 38 is optional, but in one embodiment, extends from front panel 42 in an opposite direction as primary rear panel 36. For example, auxiliary rear panel 38 extends from second fold line 44 to a free edge 90, opposite free edge 50, where in one example, free edge 90 is substantially parallel to one or more of first fold line 42, second fold line 44, and free edge 50. Opposing side panels 40 each extend from a different one of opposite side fold lines 46 away from front panel 34 to a free side edge 100.

More specifically, in one example, primary rear panel 36 includes a first angled side edge 52 and a transversely extending side edge 52 on each opposing side thereof to collectively extend from first fold line 42 to free edge 50, in one example. First angled side edge 52 angles inwardly from first fold line 42 to an intersection with transversely extending side edge 52, which, in one example, from first angled side edge 52 to free edge 50 in a manner that may be substantially perpendicularly to one or both of first fold line 42 and free edge 50. As will be further described below, in one embodiment, first angled side edge 52 and transversely extending side edges 54 are shaped and sized to not overlap with side panels 40 when header 10 is assembled and both are folded to abut interior surface of front panel 42.

Similarly, to first angled side edge 52 and transversely extending side edges 54 of primary rear panel 36, auxiliary rear panel 38 includes a second angled side edge 92 angled inwardly from second fold line 44 to an intersection with second transversely extending side edge 94, which, in one example, extends from second angled side edge 92 to free edge 90 in a manner that may be substantially perpendicularly to one or both of second fold line 44 and free edge 90. As will be further described below, in one embodiment, second angled side edges 92 and transversely extending side edges 94 are shaped and sized to not overlap with side panels 40 when header 10 is assembled and both are folded to abut interior surface of front panel 42.

One of primary rear panel 36 and auxiliary rear panel 38, for example, primary rear panel 36, integrally includes hooks 18 on an interior portion thereof, that is spaced from an outer perimeter of front primary rear panel 26 collectively formed by first fold line 42, free edge 50, first angled side edge 52, and transversely extending side edge 52. For instance, in the illustrated embodiment, two or more, for example, four our more such hooks are spaced longitudinally from each other, with each being formed to be substantially the same size and spaced substantially the same distance from first fold line 42. In one example, each of hooks 18 is substantially identical. In this manner, each hook 18 is defined between a hook fold line 74 and a cutline 56 that extends from one end of hook fold line 74 to the other to form hook 18 as a closed shape. More specifically, in one embodiment, hook fold line 74 is substantially linear and extends substantially perpendicularly relative to first fold line 42.

Cutline 56 extends from one end of hook fold line 74 to the other in a manner including a top segment 58, a first side segment 60, a cutback segment 62, a second side segment 64, a bottom segment 66, a third side segment 70, and return segment 72, in one example, for instance, such that hook 18 is defined symmetrically about a center fold line 76. In one example, top segment 58 extends away from what will be a top of hook fold line 74 in a direction substantially perpendicular thereto and/or substantially parallel to first fold line 42. Top segment 58 extends to a corner intersection with first side segment 60, which extends downwardly therefrom in a substantially linear manner to cutback segment 62. Cutback segment 62 extends from first side segment 60 partially back toward hook fold line 74 to second side segment 64. In one example, cutback segment 62 is sized with a length corresponding to a thickness of cross bar 14 (see FIG. 17) such that resultant hook 18 is able to receive cross bar 14 between second side segment 64 and a portion of exterior surface 30 formed by primary rear panel 32, as will be further described below.

Second side segment 64 extends substantially parallel to first side segment 60, from cutback segment 62 to bottom segment 66. Bottom segment 66 extends from second side segment to side segment 64 to third side segment 70, for example, extending substantially parallel to top segment 58. Third side segment 70 extends upwardly from bottom segment 66 and is sized and shaped substantially similar to second side segment 64. For example, third side segment 70 is linear and has a substantially identical length to second side segment and/or extends substantially parallel to second side segment 64. Return segment 72 extends from an end of third side segment 70 opposite bottom segment 66 substantially parallel or colinear with cutback segment 62 to a bottom end of fold line 74. In one example, center fold line 76 extends substantially parallel to hook fold line 74 between top segment 58 and bottom segment 66 in such a manner that cutback segment 62 and second side segment 64 are symmetrically positioned relative to third side segment 70 and return segment 72, respectively, about center fold line 76. In one embodiment, each of hook fold line 74 and first side segment 56 are symmetrically sized and positioned relative to one another about center fold line 76. In such an embodiment, hook 18 is divided into two substantially identically sized and shaped halves on either side of center fold line 76. Assembly including folding out of hook 18 is described in additional detail below.

In one embodiment, each of primary rear panel 36 and auxiliary rear panel 38 includes pre-applied adhesive 48 or is applied with adhesive 48 during assembly to allow each of primary rear panel 36 and auxiliary rear panel 38 to be adhered to front panel 34 during assembly. In one embodiment, auxiliary rear panel 38 is eliminated and/or primary rear panel 36 extends further toward second fold line 44, which may or may not be replaced with a free edge, as will be apparent to those of skill in the art upon reading the present application.

In one example, side panels 40 are similarly sized and shaped to extend outwardly from opposing sides of front panel 34 in a substantially symmetrical manner. For instance, each side panel 40 extends outwardly from a different one of side fold lines 46 to a different one of free side edges 100, which, in one embodiment, extend substantially parallel to side fold lines 446, which, in one embodiment, extend substantially perpendicularly relative to first fold line 42 and second fold line 44. In one example, first and second fold lines 42 and 44 each intersect or nearly intersect with opposing ends of each of side fold lines 46. Each side panel 40 includes an angled offset edge 102 on each of top and bottom sides thereof extending between corresponding ones of side fold lines 46 and free side edges 100. Angled offset edge 102 may be substantially perpendicular to side fold line 46 or, for example, as illustrated in the figures, may be tapered inwardly from each of first fold line 42 and second fold line 44 toward the other of first fold line 42 and second fold line 44. In one example, each angled offset edge 102 is collinear with a different one of first angled side edge 52 or second angled side edge 92. In one embodiment, each of side panels 40 includes pre-applied adhesive 48 or is applied with adhesive 48 during assembly to allow each of side panels 40 to be adhered to front panel 34 during assembly, as will be additionally described below. A cutout or slot 104 may or may not be formed along any one of first fold line 42, second fold line 44, and side fold lines 46 to allow a crisper and/or easier fold to be made along side fold lines 46 when each side panel 40 is folded rearwardly about the corresponding fold line.

Figure 13:
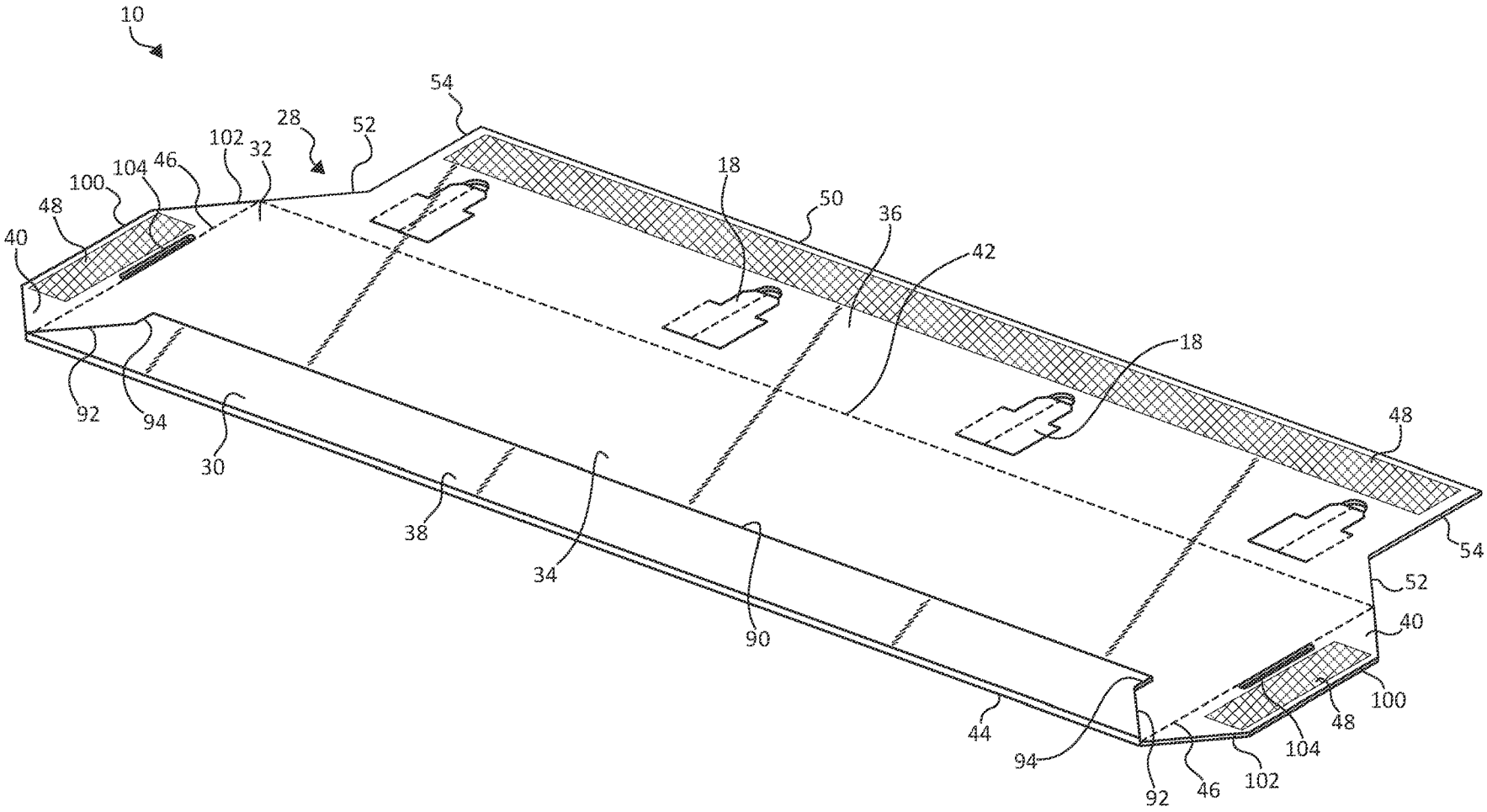
FIG. 13 is a rear perspective view illustration of the header blank of FIG. 11 in a partially folded position, according to one embodiment of the present invention.

Once blank 28 is cut from a planar material and fold lines and interior cut lines are formed, it is easily, stacked and flat packed for sending to a retail store or other suitable environment for assembly and use. Upon arrival of blank 28 at the retail store, for example, a team member can quickly assemble blank 28 into header 10 and hang header 10 on a cross bar 14 (wee FIG. 17) generally without the need for tools, coupling members, or any other additional items other than blank 28. One example of a process for assembling header 10 is shown sequentially in FIGS. 13-16, which will be described herein in detail. As shown in FIG. 13, blank 28 is first placed so exterior surface 30 is placed downwardly, preferably onto a hard surface (not shown), such as a table, floor, etc. In this manner, any indicia 16 (see FIG. 12) faces away from the team member assembling blank 28 into header 10.

Once blank 28 is so placed, primary rear panel 36, auxiliary rear panel 38, and side panels 40 are each folded about a respective one of first fold line 42, second fold line 44, and side fold lines 46 nearly 180 degrees such that each of primary rear panel 36, auxiliary rear panel 38, and side panels 40 are adhered, with portions of interior surface 32 facing each other, to front panel 34. For example, as shown in FIG. 13, any protective tape, etc., covering adhesive 48 on auxiliary panel 38 is removed, and auxiliary panel 38 is folded about second fold line 44 until auxiliary panel 38 extends adjacent to and substantially parallel with front panel 34. Auxiliary panel 38 is thereby folded to have corresponding portions of interior surface 32 of auxiliary panel 38 and front panel 36 abut each other. Auxiliary panel 38 is firmly pressed down on to front panel 34 such that adhesive 48 on auxiliary panel 38 contacts and is secured to front panel 34 to hold auxiliary panel 38 in place on back side of front panel 34 via adhesive 48.

Figure 14:
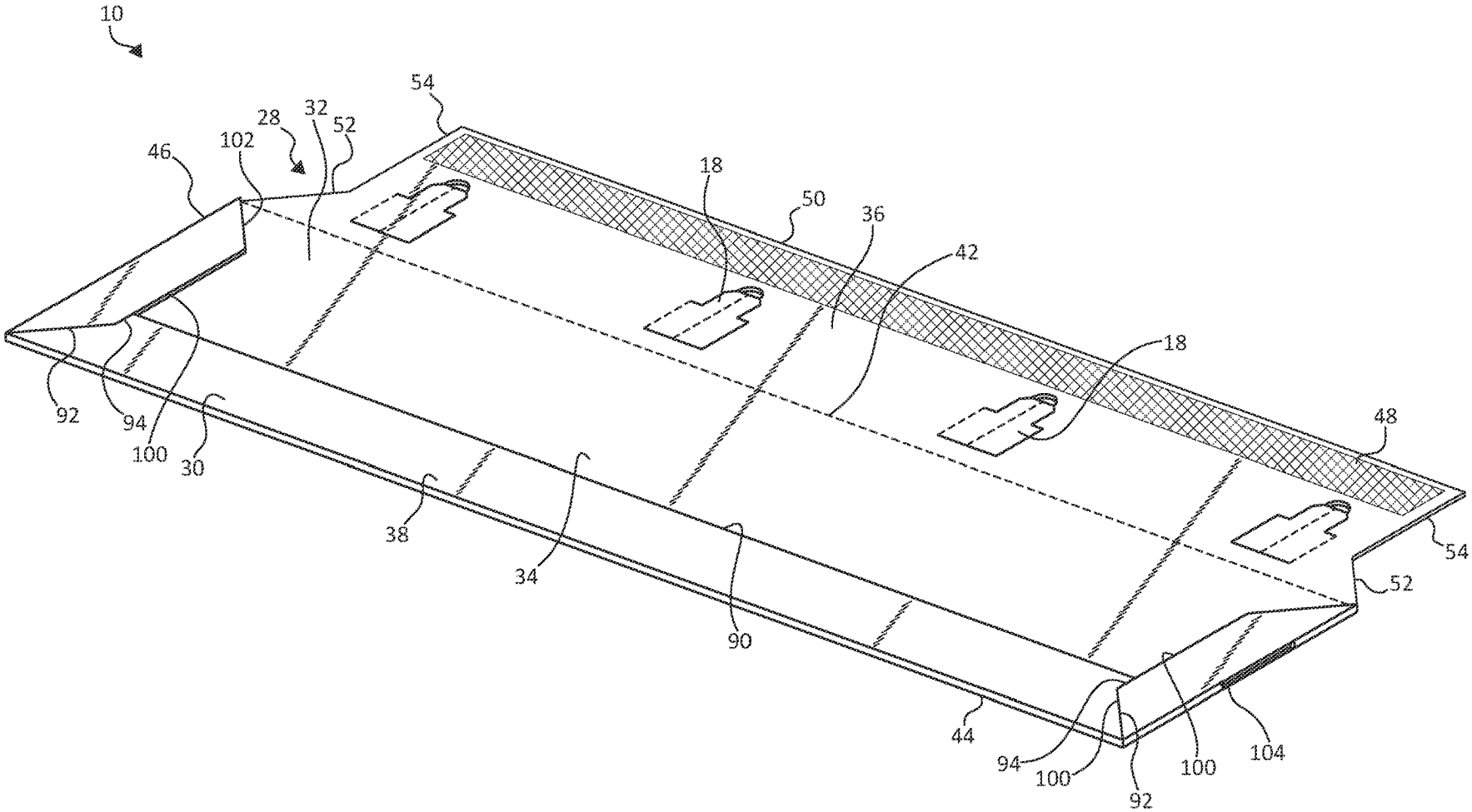
FIG. 14 is a rear perspective view illustration of the header blank of FIG. 11 in a partially folded position, according to one embodiment of the present invention.

Turning to FIG. 14, a similar process is repeated for each of the two side panels 40. More specifically, any protective tape, etc., covering adhesive 48 on each side panel 40 is removed, and each side panel 40 is folded about an adjacent one of side fold lines 46 until each side panel 40 extends adjacent to and substantially parallel with front panel 34. Each side panel 40 is thereby folded to having corresponding portions of interior surface 32 of each side panel 40 and front panel 36 abut each other. Each side panel 40 is firmly pressed down on to front panel 34 such that adhesive 48 on side panels 40 contacts and is secured to front panel 34 to hold each side panel 40 in place on back side of front panel 34 via adhesive 48.

In one embodiment, each of side panels 40 and auxiliary rear panel 38 are sized and shaped to neatly nest with each other at lower corners of header 10 forming a neat, for example, an at least partially mitered corner of header 10. More particularly, turning to FIG. 14, in one example, since angled offset edge 102 is collinear to second angled side edge 92 when in the form of blank 28, when a side panel 40 and auxiliary rear panel 38 are folded into place, angled offset edge 102 and second angled side edge 92 substantially abut one another to form a mitered corner. Where a height of auxiliary rear panel 38 extends beyond a free corner of one of side panels 40, side edge 94 of auxiliary rear panel 38 extends immediately adjacent to an along a lower portion of free edge 100 of side panel 40, in one example.

Figure 15:
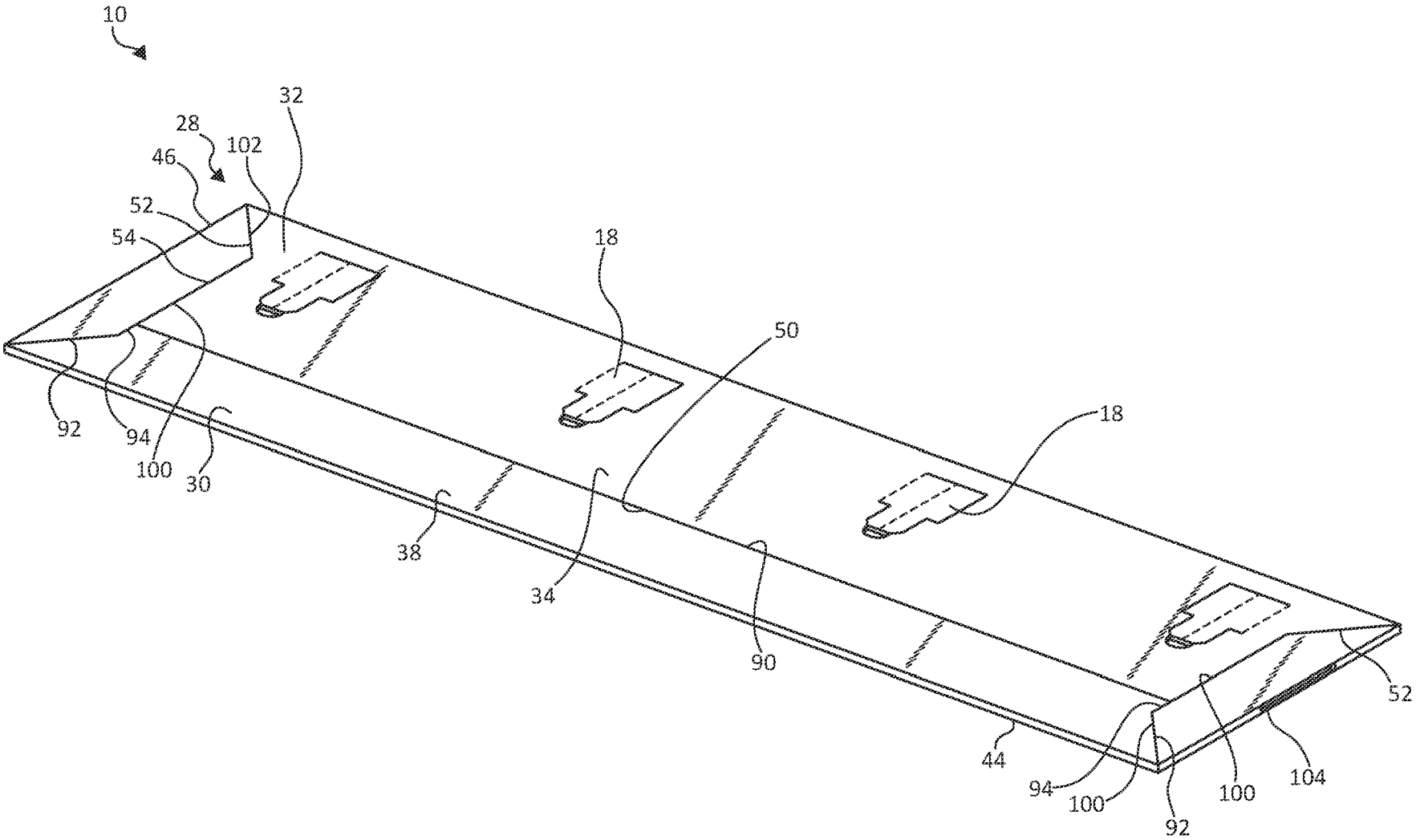
FIG. 15 is a rear perspective view illustration of the header blank of FIG. 11 in a partially folded position, according to one embodiment of the present invention.

Turning to FIG. 15, primary rear panel 32 folded rearwardly and secured to front panel 34. More specifically, any protective tape, etc., covering adhesive 48 on primary rear panel 32 is removed, and primary rear panel 32 is folded about first fold line 42 until primary rear panel 32 extends adjacent to and substantially parallel with front panel 34. Primary rear panel 32 thereby is folded to having corresponding portions of interior surface 32 of each of primary rear panel 32 and front panel 36 abut one another. Primary rear panel 32 is firmly pressed down on to front panel 34 such that adhesive 48 on primary rear panel 32 contacts and is secured to front panel 34 to hold primary rear panel 32 in place on back side of front panel 34 via a corresponding adhesive 48.

In one embodiment, each of side panels 40 and primary rear panel 32 are sized and shaped to neatly nest with each other at upper corners of header 10 forming a neat, for example, an at least partially mitered corner of header 10. More particularly, as illustrated, in one example, since first angled side edge 52 is collinear to angled offset edge 102 when in the form of blank 28, when a side panel 40 and primary rear panel 32 are folded into place, angled offset edge 102 and first angled side edge 52 substantially abut one another to form a substantially mitered corner. Where a height of primary rear panel 32 extends beyond a free corner of one of side panels 40, first angled side edge 52 of primary rear panel extends immediately adjacent to an along a lower portion of free edge 100 of side panel 40 opposite auxiliary rear panel 38, in one example. In one embodiment, primary rear panel 32 extends along a rear of front panel 34 a sufficient distance such that free edge 50 is positioned adjacent to free edge 90 of auxiliary rear panel 38. In this manner a substantial entirety of the corresponding header 10 is of dual thickness, but otherwise remains a substantially planar member of sufficient strength to maintain the substantially planarity during a lengthy use time on cross bar 14.

Figure 16:
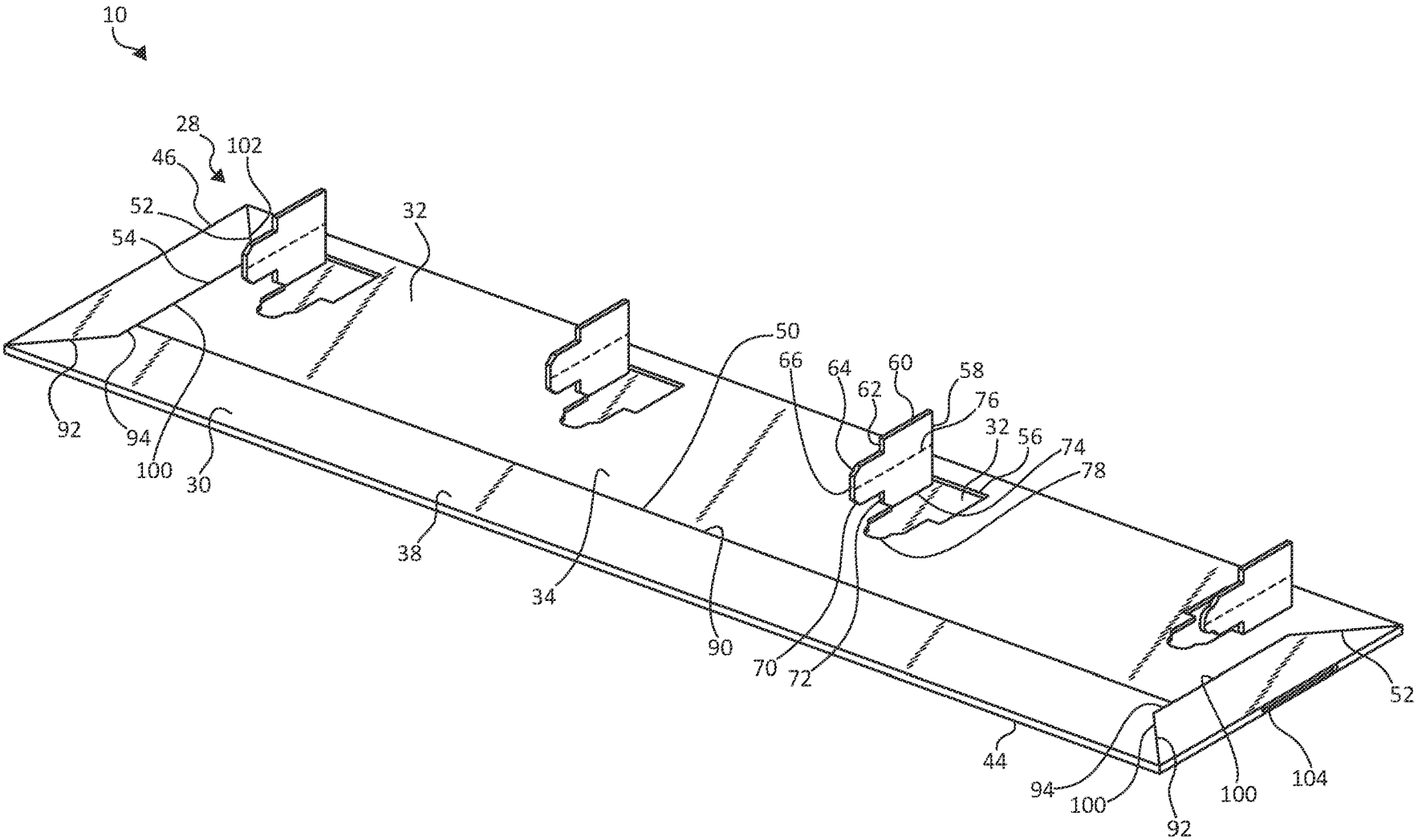
FIG. 16 is a rear perspective view illustration of the header blank of FIG. 11 in a partially folded position, according to one embodiment of the present invention.

In order to hang header 10 in a positioned as desired, hooks 18 are folded out, rearwardly from primary rear panel 32 to extend further away from front panel 34 than a remainder of primary rear panel 32, as show, for instance in FIG. 16. In one example, each hook 18 is folded to extend rearwardly from primary rear panel 32 about hook fold line 74. In one embodiment, cut line 56 of each hook 18 further defines a void just below bottom segment 66 thereof, which serves as an access point 68 for pulling hook 18 outwardly from a remainder of primary rear panel 32. For instance, access point 68 is sized to allow a team member to slide his or her finger into access point 68 so that he or she is able to interact with bottom segment 66 of hook 18, and pull hook rearwardly about hook fold line 74 exposing a portion of interior surface 32 of front panel in a void of primary rear panel 32 that was once where hook 18 was formed as shown in FIG. 16.

Figure 17:
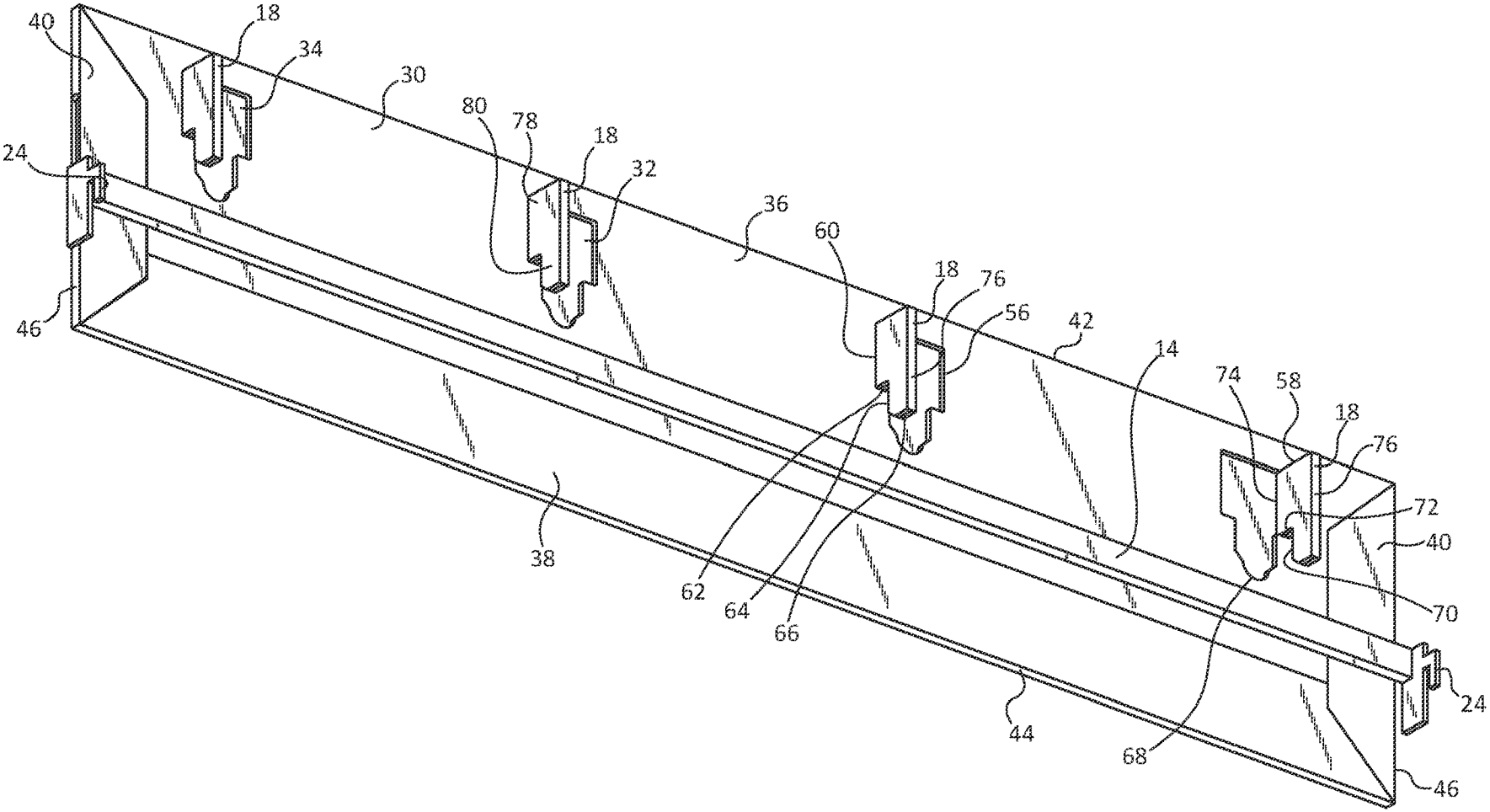
FIG. 17 is a rear perspective view illustration of an assembled header and cross bar of the retail display fixture of FIG. 1, according to one embodiment of the present invention.

Turning to FIG. 17, each hook 18 is then folded substantially in half about its center fold line 76. When so folded first side segment 60 of cutline 56 is placed to abut a back of front panel 34 through the void left in primary rear panel 34. The abutment and additional contact with hook 18 and a remainder of header 10 makes hook 18 dual-layer increasing both the strength and rigidity of each hook 18. When so formed hook 18 defines an offset 78, from primary rear panel 32 extending from each of hook fold line 74 to third side segment 70 and from first side segment 60 to second side segment 64, and a downwardly extending leg 80 spaced from a remainder of primary rear panel 32 via offset 78 and extending downwardly beyond cut back segment 72 and return segment 70. This process is repeated for each of hooks 18.

When formed as described in the example embodiment above, each of hooks 18 extends rearwardly and then downwardly from a portion of exterior surface 30 defined by primary rear panel 36. Once fully assembled, header 10 is ready to be hung as part of retails display system 12 (FIG. 1), more particularly, onto a cross bar 14. In one example, header 10 is formed of a length to cover a substantial entirety of a length of cross bar 14 as defined between hooked brackets 24. In other examples, header 10 is shorter or longer than cross bar 14. Regardless of its size, header 10 is longitudinally aligned with cross bar 14, is moved rearwardly toward cross bar 14 to place exterior surface 30 of primary rear panel in a position substantially adjacent and/or abutting a front surface of cross bar 14. Then, header 10 is moved downwardly such that each of hooks 18 engages with and is placed on cross bar 14. More particularly, in one embodiment, cross bar 14 is positioned to be sandwiched between downwardly extending leg 80 of each hook and the corresponding portion of exterior surface 30 of primary rear panel 36. Due to the rigidity of the resultant dual-layer header 10, header 10 extends rigidly and substantially vertically in front of cross bar 14, for example, substantially entirely, if not fully entirely, covering cross bar 14 from view when viewed from a front side thereof. Conversely, when a team member wishes to remove header 10 from cross bar 14, he or she simply pushes header 10 upwardly until hooks 18 disengage and are positioned fully above cross bar 14. At this point, header 10 is easily pulled forward away from retail display system 12 for disposal, recycling, reuse in another portion of the retail store, etc. as described by the team member.

Although the invention has been described with respect to particular embodiments, such embodiments are meant for the purposes of illustrating examples only and should not be considered to limit the invention or the application and uses of the invention. Various alternatives, modifications, and changes will be apparent to those of ordinary skill in the art upon reading this application. Furthermore, there is no intention to be bound by any theory presented in the preceding background of the invention or the above detailed description.

What is claimed is:

1. A header configured to be coupled to a retail display structure, the header comprising:

a front panel;

a rear panel initially formed coplanarly with the front panel and bordering the front panel along a longitudinally extending fold line, the rear panel being folded about the longitudinally extending fold line to fit adjacent to and be adhered to an interior surface of the front panel, wherein:

at least two hooks are initially coplanarly formed in an interior of the rear panel and coupled to a remainder of the rear panel via a fold line, and each of the at least two hooks is folded rearwardly away from the rear panel to define an offset portion and a downwardly extending portion, the downwardly extending portion being spaced from an exterior surface of the rear panel via the offset portion in a manner configured to receive at least a portion of the retail display structure between the exterior surface of the rear panel and the downwardly extending portion of each of the at least two hooks.

2. The header of claim 1, wherein the front panel and the rear panel are both integrally formed as part of a single piece of a substantially planar material.

3. The header of claim 2, wherein each of the at least two hooks is folded in half about a center fold line thereof to form each of the at least two hooks as a dual layer of the substantially planar material.

4. The header of claim 3, wherein each of the at least two hooks is symmetrically formed about the center fold line thereof.

5. The header of claim 1, wherein the substantially planar material is corrugated cardboard.

6. The header of claim 1, wherein other than the at least two hooks, the rear panel is placed immediately adjacent to and substantially parallel with the front panel.

7. The header of claim 1, wherein the rear panel includes an access void adjacent a bottom edge of each of the at least two hooks to allow each of the at least two hooks to be grasped and folded away from a remainder of the rear panel.

8. The header of claim 1, wherein:

the rear panel is a primary rear panel, the longitudinally extending fold line is a first longitudinally extending fold line, the header further comprises an auxiliary rear panel coupled to the front panel along a second longitudinally extending fold line, the primary rear panel extends from the first longitudinally extending fold line toward the second longitudinally extending fold line, the auxiliary rear panel extends from the second longitudinally extending fold line toward the first longitudinally extending fold line and is coupled to the front panel to extend substantially coplanarly with the primary rear panel.

9. The header of claim 8, wherein the primary rear panel and the auxiliary rear panel abut one another opposite respective ones of the first longitudinally extending fold line and the second longitudinally extending fold line.

10. The header of claim 8, wherein the primary rear panel and the auxiliary rear panel extend to one another and terminate absent any overlap between the primary rear panel and the auxiliary rear panel.

11. The header of claim 8, wherein the first longitudinally extending fold line and the second longitudinally extending fold line are substantially parallel to and positioned opposite one another relative to the front panel.

12. The header of claim 8, where the primary rear panel and the auxiliary rear panel are both adhered to the front panel.

13. The header of claim 1, wherein:

the header further comprises a different side panel on each of opposing ends of the front panel, each of the different side panels extends from a side fold line immediately adjacent the front panel and is folded back over the front panel to extend toward another one of the different side panels, and each of the different side panels is coupled to the front panel to extend substantially coplanarly with the rear panel.

14. The header of claim 13, wherein each of the side panels abuts the rear panel forming a substantially mitered corner of the header.

15. The header of claim 13, wherein:

the rear panel is a primary rear panel, the longitudinally extending fold line is a first longitudinally extending fold line, the header further comprises an auxiliary rear panel coupled to the front panel along a second longitudinally extending fold line, the primary rear panel extends from the first longitudinally extending fold line toward the second longitudinally extending fold line, and the auxiliary rear panel extends from the second longitudinally extending fold line toward the first longitudinally extending fold line and is coupled to the front panel to extend substantially coplanarly with the primary rear panel.

16. The header of claim 15, wherein each of the side panels abuts the auxiliary rear panel forming a substantially mitered corner of the header.

17. The header of claim 15, wherein the side panels, the primary rear panel, and the auxiliary rear panel collective cover a substantial entirety of the interior surface of the front panel other than through voids formed when each of the at least two hooks is folded to extend rearwardly from the primary rear panel.

18. The header of claim 15, wherein the side panels, the primary rear panel, and the auxiliary rear panel are each secured to extend over the interior surface of the front panel via adhesive pre-applied to each of the side panels, the primary rear panel, and the auxiliary rear panel.

19. The header of claim 1, in combination with a retail fixture having a cross bar, wherein the header is selectively coupled to the cross bar by placing the at least two hooks over the cross bar to maintain portions of the cross bar between the downwardly extending portion of each of the at least two hooks and a remainder of the rear panel.

20. The header of claim 1, wherein the interior surface of the front panel is visible through voids left in the rear panel when the hooks are folded to extend rearwardly from the rear panel.

* * * * *